US007905164B2

(12) United States Patent
Kozak et al.

(10) Patent No.: US 7,905,164 B2
(45) Date of Patent: Mar. 15, 2011

(54) ADJUSTABLE ONE WAY SCREW REMOVER

(75) Inventors: Burton Kozak, Chicago, IL (US); Ira Kozak, Riverwoods, IL (US)

(73) Assignee: Combined Products Co. #1 Inc., Chicago, IL (US)

( * ) Notice: Subject to any disclaimer, the term of this patent is extended or adjusted under 35 U.S.C. 154(b) by 239 days.

(21) Appl. No.: 12/284,155

(22) Filed: Sep. 18, 2008

(65) Prior Publication Data

US 2010/0064863 A1 Mar. 18, 2010

(51) Int. Cl.
*B25B 23/10* (2006.01)

(52) U.S. Cl. ..... 81/453; 81/441

(58) Field of Classification Search ..... 81/452, 81/453, 53.2, 437, 438, 441
See application file for complete search history.

(56) References Cited

U.S. PATENT DOCUMENTS

| | | | |
|---|---|---|---|
| 673,056 | A | 4/1901 | Jacobs |
| 1,105,535 | A | 7/1914 | Roberts |
| 1,129,049 | A | 2/1915 | Smith |
| 1,863,045 | A | 6/1932 | Randall |
| 1,863,046 | A | 6/1932 | Githens |
| 2,066,132 | A | 12/1936 | Zihler |
| 2,103,944 | A | 12/1937 | Gullborg |
| 2,480,648 | A | 8/1949 | Harer |
| 3,135,306 | A | 6/1964 | Mangerian |
| 3,161,090 | A | 12/1964 | McLellan |
| 3,392,767 | A | 7/1968 | Stillwagon |
| 3,517,714 | A | 6/1970 | Desbarats |
| 3,590,235 | A | 6/1971 | Leo |
| 3,604,488 | A | 9/1971 | Wishart |
| 3,678,789 | A | 7/1972 | Wilson |
| 3,739,825 | A | 6/1973 | Knox |
| 4,189,266 | A | 2/1980 | Koslow |
| 4,429,599 | A | 2/1984 | La Sante |
| 4,569,259 | A | 2/1986 | Rubin |
| 4,604,917 | A | 8/1986 | Polonsky |
| 4,682,917 | A | 7/1987 | Williams |
| 4,716,793 | A | 1/1988 | Tauber |
| 4,777,850 | A | 10/1988 | Polonsky |
| 4,800,787 | A | 1/1989 | Cerny |
| 5,031,487 | A | 7/1991 | Polonsky |
| D329,786 | S | 9/1992 | Polonsky |

(Continued)

FOREIGN PATENT DOCUMENTS

| | | |
|---|---|---|
| WO | WO 01/66310 | 9/2001 |

(Continued)

OTHER PUBLICATIONS

International Search Report and Written Opinion of International Application No. PCT/US09/056977, International Filing Date of Sep. 15, 2009, consisting of 8 pages.

*Primary Examiner* — David B Thomas
(74) *Attorney, Agent, or Firm* — Factor & Lake, Ltd.

(57) ABSTRACT

A tool for removing conventional one way fasteners that includes, generally, a member, a collar, and, a shaft that can be removably received by the collar, wherein in the shaft is configured to engage regions of the fastener head. The collar is adjustable to fit fastener heads of different sizes. The member can be configured to correspond to a threaded portion of the outer surface of the collar. The collar may also have a bottom portion that includes multiple splines.

12 Claims, 6 Drawing Sheets

U.S. PATENT DOCUMENTS

| | | | | |
|---|---|---|---|---|
| D340,184 | S | 10/1993 | Desaulniers | |
| 5,251,516 | A | 10/1993 | Desaulniers | |
| 5,450,776 | A | 9/1995 | Kozak | |
| 5,520,075 | A | 5/1996 | Barmore | |
| 5,533,426 | A | 7/1996 | Morales | |
| 5,551,320 | A | 9/1996 | Horobec | |
| 5,664,467 | A * | 9/1997 | Breeze | 81/114 |
| 5,819,611 | A | 10/1998 | Kozak | |
| 5,827,019 | A | 10/1998 | Morrissey | |
| 6,047,620 | A | 4/2000 | Kozak | |
| 6,595,730 | B2 | 7/2003 | Bergamo | |
| 6,598,498 | B1 | 7/2003 | Pigford | |
| 6,701,812 | B1 * | 3/2004 | Sawamura | 81/453 |
| 6,742,416 | B2 | 6/2004 | Bergamo | |
| 6,978,697 | B2 | 12/2005 | Kozak | |
| 2002/0127071 | A1 | 9/2002 | Vasudeva | |
| 2003/0136228 | A1 | 7/2003 | Liu | |
| 2004/0134688 | A1 | 7/2004 | Papousek | |
| 2006/0191379 | A1 | 8/2006 | McCalley | |

FOREIGN PATENT DOCUMENTS

| | | |
|---|---|---|
| WO | WO 2004/002687 | 1/2004 |

* cited by examiner

ADJUSTABLE ONE WAY SCREW REMOVER

RELATED APPLICATIONS

None.

TECHNICAL FIELD

The present invention relates generally to devices used for removing fasteners and, more particularly, to an adjustable device for removing one way fasteners.

BACKGROUND

One way fasteners are well known to those of ordinary skill in the art. Generally, these fasteners are constructed with features that allow a threaded shank portion of the fastener, usually a threaded screw type configuration, to pass through an orifice in one structure and ultimately "screw" into an adjacently positioned second structure until a head portion of the fastener engages the first structure. Once the head portion engages the first structure, the one way fastener is very difficult to remove due to diametrically opposed flat and convex portions that are configured to provide a recess that receives a screwdriver and allows the screwdriver to forcibly insert the fastener into the second structure when the screwdriver is rotated clockwise, but prevents the screwdriver from extracting the fastener when the screwdriver is rotated in a counter-clockwise direction.

Conventional one way fasteners are nothing more than a conventional rounded head screw with diametrically opposed quadrants machined flat. This rounded head feature contributes significantly to the problem of extracting a one way fastener. One way fasteners are very effective in preventing unauthorized persons or vandals from separating the fastener-joined structures. However, occasions do arise requiring the difficult task of removing one way fasteners.

Prior art extraction devices utilize features such as jaws to grasp the sides of the head of a fastener for removal. Examples of such devices are illustrated in U.S. Pat. Nos. 5,551,320 and 5,533,426. Unfortunately, these devices are of no use when there are no accessible sides to the fastener head.

Another prior art extraction device details a tool having a pair of "tips" for engaging a pair of tip receiving recesses in the head of the one way fastener. Such a device is depicted in U.S. Pat. No. 5,450,776 issued to the applicant. The device further includes a collar with asymmetrical radial serrations to grasp the periphery of the fastener head. This tip-recess and collar-head interaction provides the "foothold" necessary to maximize the effect of any rotational force applied to the fastener removal tool. This device is limited to extracting a specially designed fastener. The device cannot function optimally when a conventional fastener such as that described above is encountered.

In addition, U.S. Pat. No. 6,047,620, also issued to the present inventors and the entirety of which is incorporated herein by reference, discloses a tool for removing conventional one way fasteners. The device generally includes a collar and a shank that can be removably received by the collar, wherein in the shank is configured to engage complementary regions of the fastener head. The collar includes a recess having longitudinal ridges to engage perimeter portions of the fastener head. The shank and collar cooperate to provide additional rotational force to the fastener to thereby extract the fastener, whether the fastener is flush-mounted or counter-sunk. However, while these types of fasteners (with collars) are effective for their intended purpose, due to variations in the diameter of the fasteners, a collar may not fit over a certain fastener, and almost certainly not over multiple fasteners, each with differing head sizes.

Therefore, a need exists in the art for an adjustable fastener removal tool for extracting one way fasteners that can be adjusted to fit snuggly around a fastener. In addition, a need in the art exists for an adjustable fastener removal tool that is capable of extracting multiple differently sized one way fasteners.

SUMMARY OF THE INVENTION

It is an object of the present invention to provide a device for extracting one way fasteners that overcomes many of the disadvantages of the prior art.

It is another object of the present invention to provide a device for extracting one way fasteners that is adjustable.

It is still another object of the present invention to provide a device for extracting one way fasteners that is adjustable to fit a first one way fastener, that has a head with a first diameter, and a second one way fastener that has a head which has a different diameter than the first diameter.

Such a device is beneficial because one way fasteners made by different manufacturers, while purportedly being the same size (for example a size 15), may include minute variations which might cause the one way fasteners to actually have differently sized heads. Thus, an extracting device may not fit both of the one way fasteners—even though they are purportedly the same size.

In general, an embodiment of the present invention provides a device for extracting a one-way fastener which includes a shaft and a collar having a first end, a second end, and an outer surface, the first end having an aperture adapted to receive the shaft, the second end being an open end and having a diameter, the outer surface having a threaded portion, and, a member engaging the threaded portion such that rotation of the member provides the second end with a second diameter.

In addition, a second embodiment of the present invention provides a device for removing a plurality of one-way fasteners which includes, generally, a shaft having a face adapted to engage the recess of a one way fastener, a collar having a first end with an aperture adapted to receive the shaft and a second end being an adjustable open end and having a first diameter corresponding to a head of a first one-way fastener from the plurality of one-way fasteners in a first configuration and a second diameter corresponding to a head of a second one-way fastener from the plurality of one-way fasteners in a second configuration.

Furthermore, a third embodiment of the present invention provides a device for extracting a one way fastener which, generally, has a shaft having a face adapted to engage the recess of a one way fastener, a collar having a first end and a second end, the first end having an aperture adapted to receive the shaft, the second end being an open end and having a diameter, and a plurality of slits having a length less than the distance from the first end to the second end.

BRIEF DESCRIPTION OF THE DRAWINGS

The present invention will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

DETAILED DESCRIPTION OF THE PRESENT INVENTION

Figure 1:
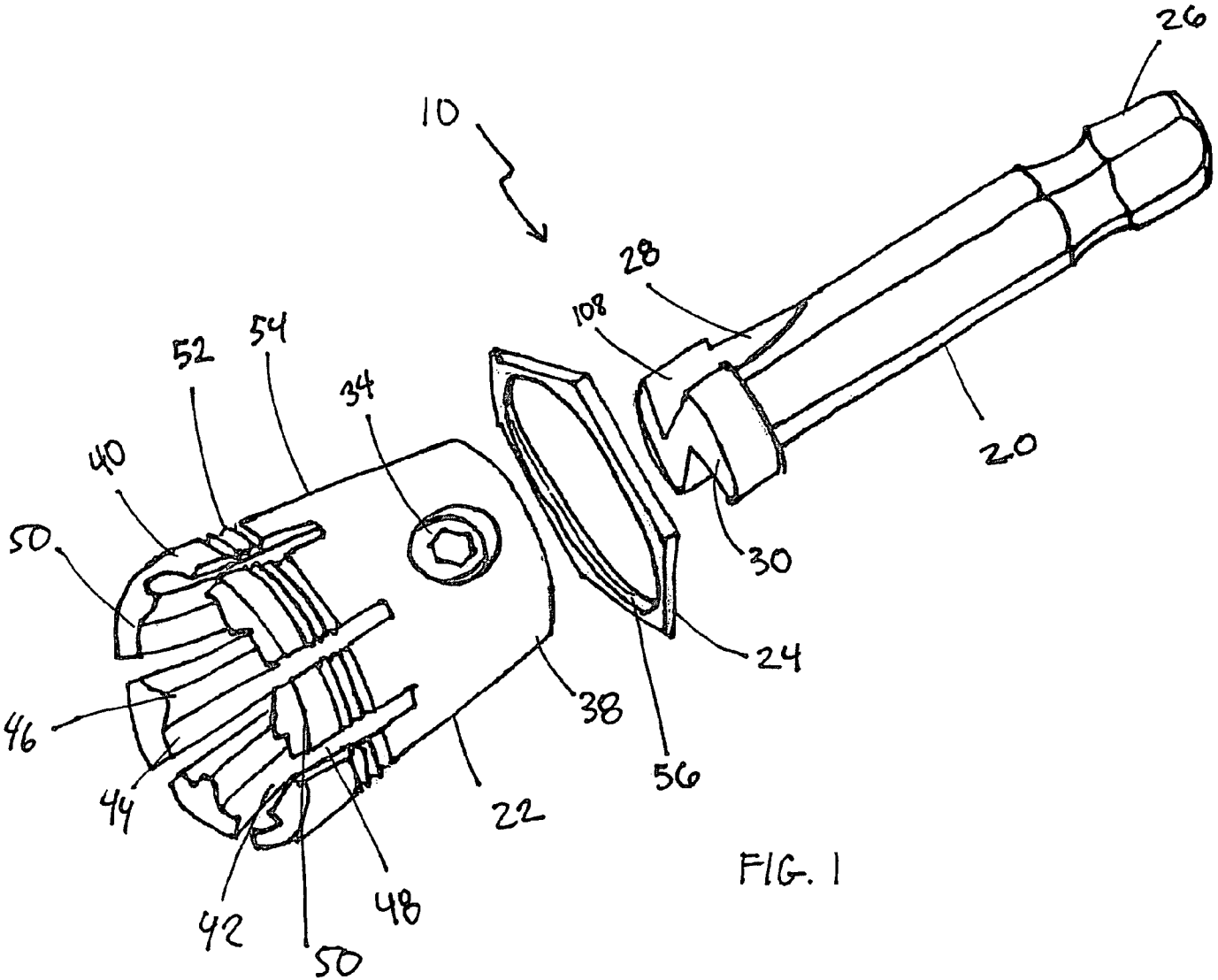
FIG. 1 is a side perspective view of a tool for removing one way fasteners in accordance with the present invention.
Figure 2:
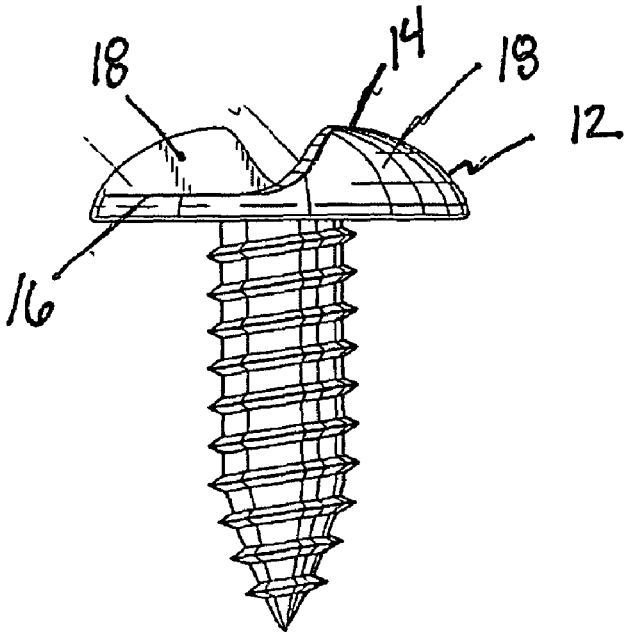
FIG. 2 is a side elevation view of a conventional fastener to be extracted with the tool depicted in FIG. 1.
Figure 3:
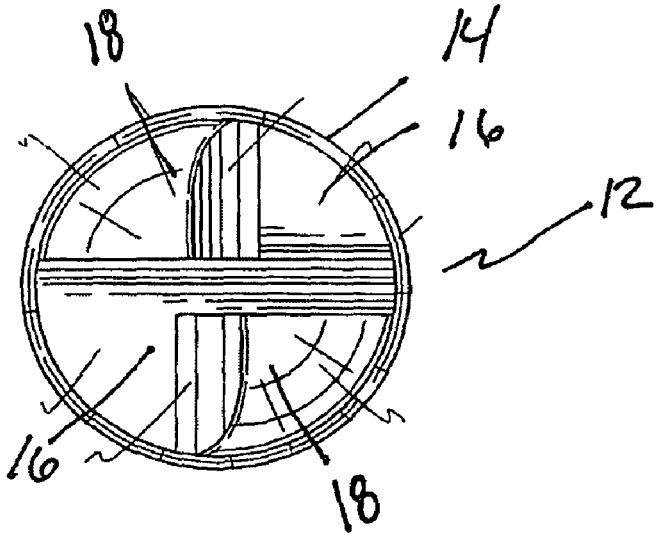
FIG. 3 is a top view of the conventional fastener of FIG. 2.
Figure 4:
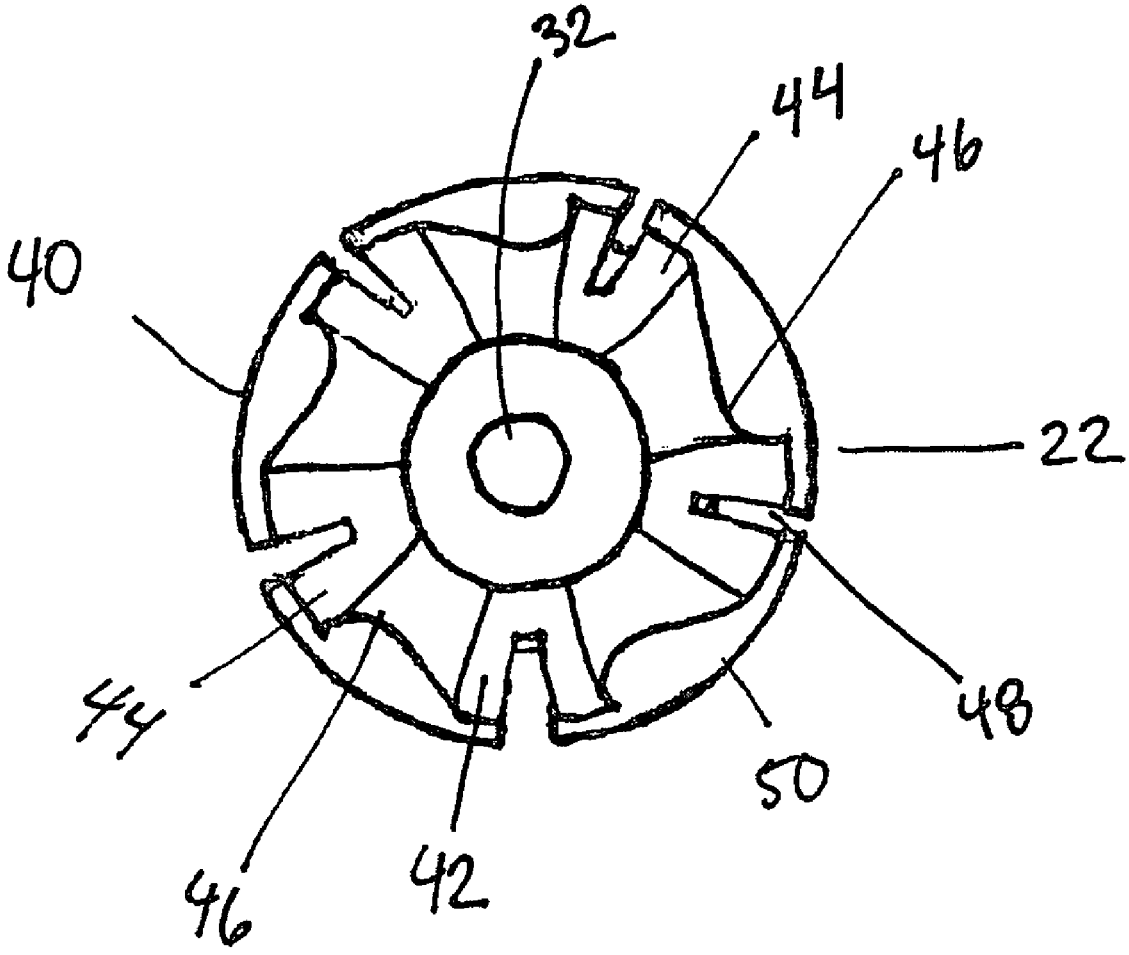
FIG. 4 is a bottom view of a collar for a tool in accordance with the present invention.
Figure 5A:
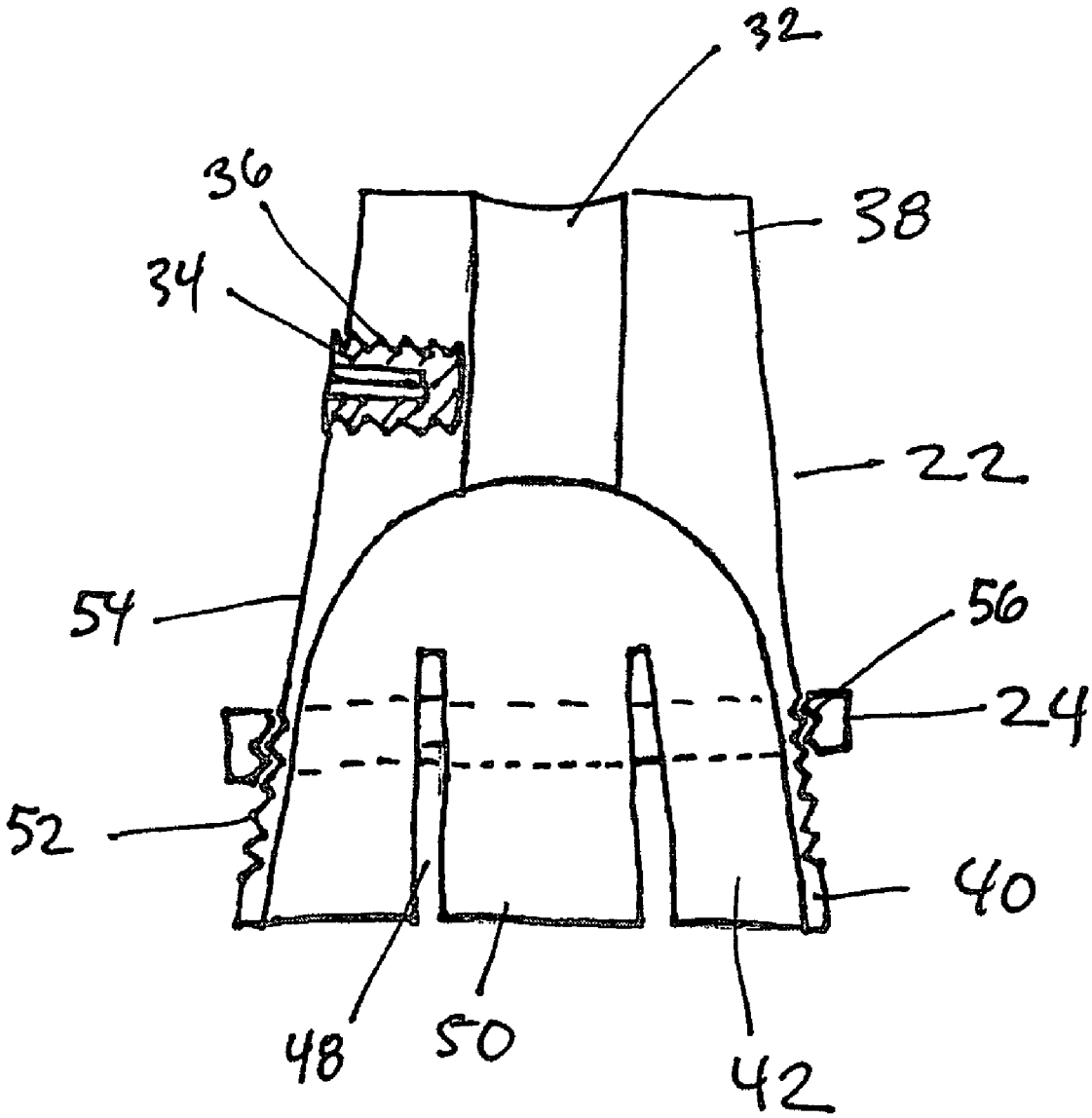
FIG. 5A is a cutaway side sectional view of first configuration of a collar in accordance with the present invention.
Figure 5B:
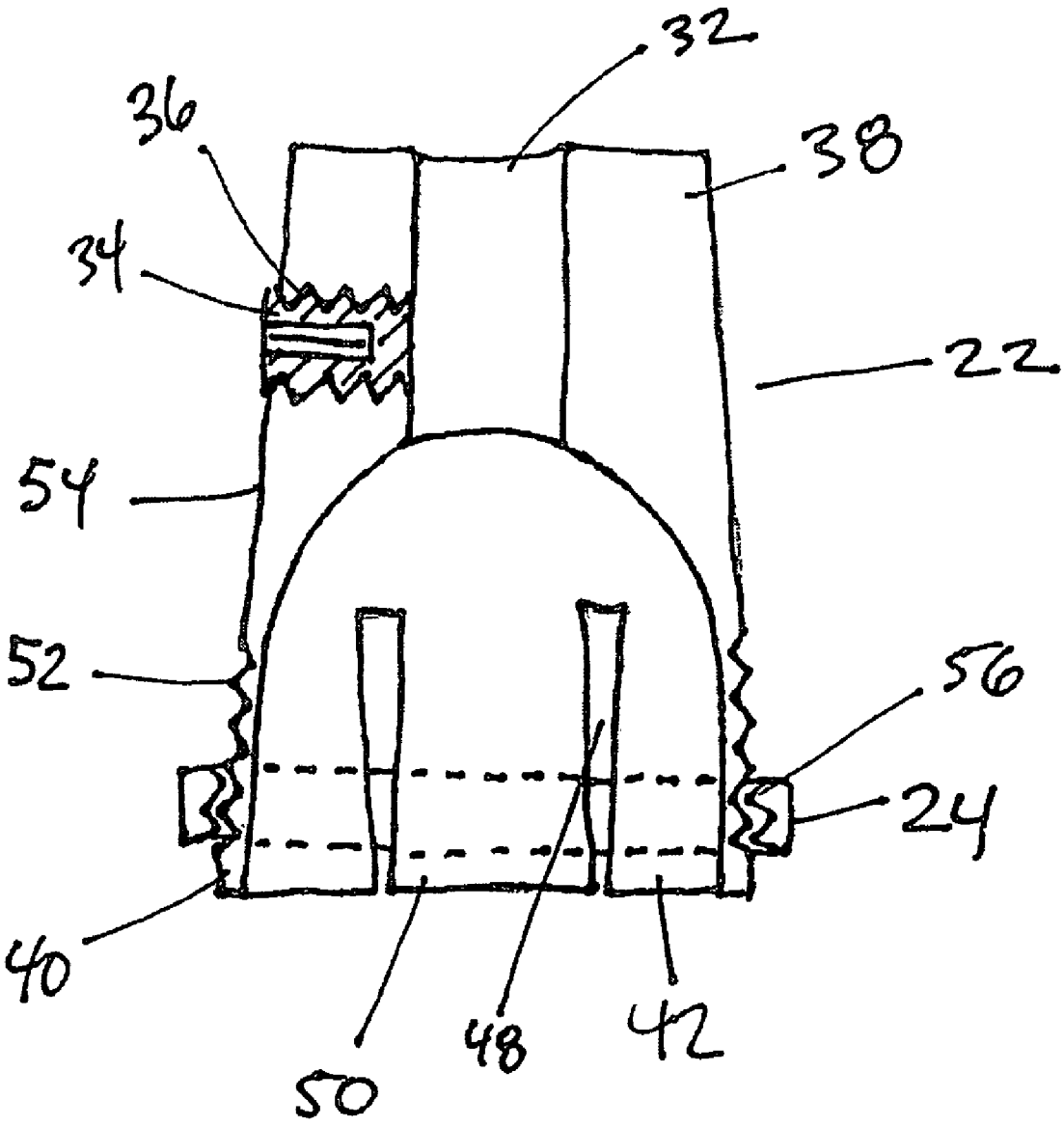
FIG. 5B is a cutaway side sectional view of second configuration of the collar in FIG. 5A.

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but does not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

In the illustrations given and more particular in FIGS. 1, 4, 5A and 5B, the reference numeral 10 designates generally a device or tool for removing a conventional type one way fastener 12. The fastener 12 can be a threaded screw type, having a head 14 with substantially planar diametrically opposed upper head surface portions 16, and convex diametrically opposed upper head surface portions 18.

The device 10 generally includes a shaft 20, a collar 22, and a member 24. The shaft 20, or a portion of the shaft, preferably top end 26, can have a hexagonal configuration to facilitate the device 10 being driven by a tool. The shaft 20 has a top end 26 and a bottom end 28. The bottom end 28 of the shaft 20 includes a face 30.

Figure 6:
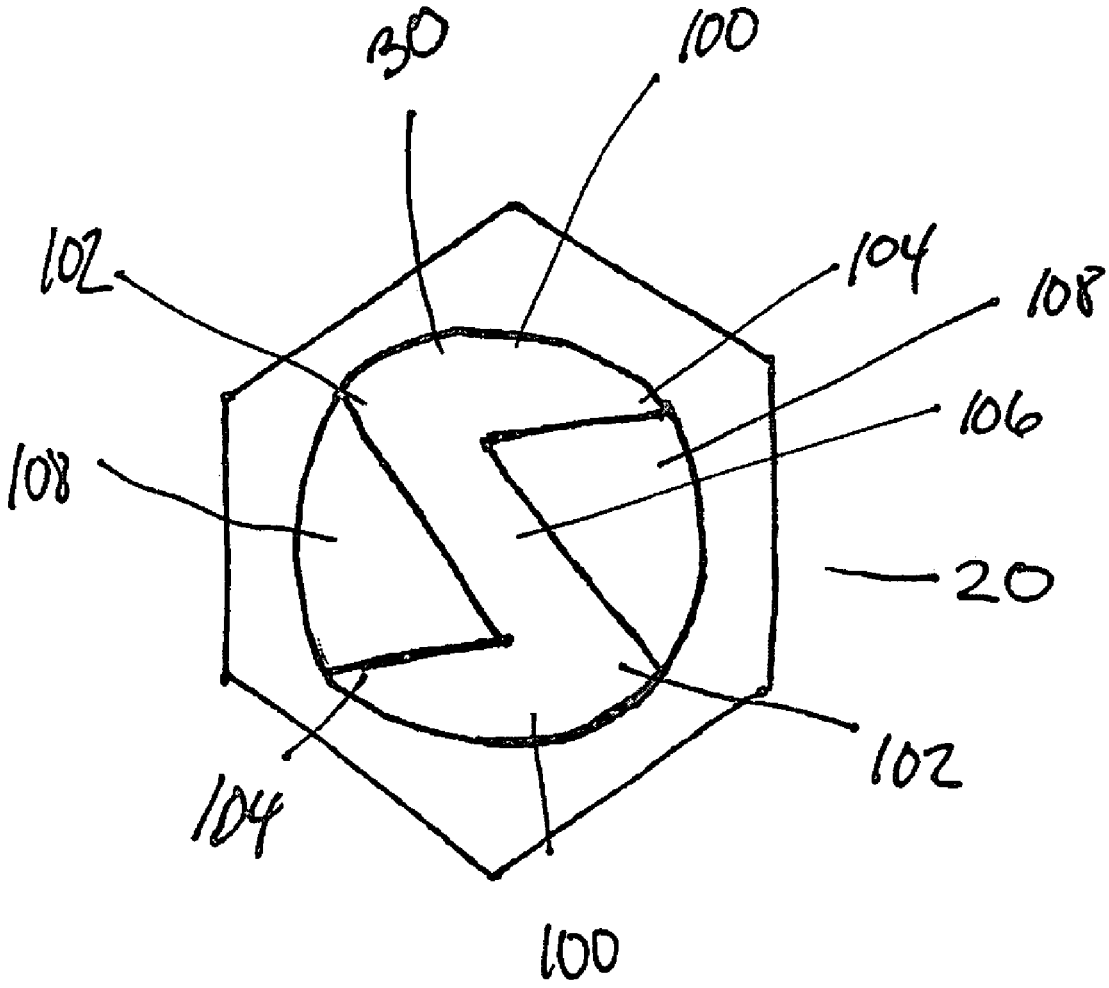
FIG. 6 is a bottom view of a face of a shaft in accordance with the present invention.

The face 30 is configured to engage the head 14 of a one way fastener 12. As shown in FIG. 6, one embodiment of the face 30 includes two lobes 100, each lobe 100 having a flat end 102 and a pointed end 104. The flat ends 102 and pointed ends 104 are alternating. The flat ends 102 of the lobes 100 are connected via a diagonal cross member 106. There are two sliced out portions 108 on opposite sides of the shaft 20. From a bottom view, the face 30 resembles of an "S." One of ordinary skill in the art should appreciate that this design is to rotate a fastener 12 in a counter clockwise rotational direction, and should it be needed, the face 30 could be designed to allow for a clockwise rotational direction for an appropriate fastener 12.

The collar 22 has a first end 38 (or upper end) and a second end 40 (or lower end). In a preferred embodiment the collar 22 is tapered such that the first end 38 has a smaller diameter than the second end 40. The shaft 20 is received in the collar 22, through an aperture 32 located in the first end 38 (or upper end) of the collar 22. Preferably, the shaft 20 is removably received in the collar 22, for example by utilizing a setscrew 34 and a threaded aperture 36 in, for example, the first end 38 of the collar 22.

The second end 40 of the collar 22 is open and has a diameter. Inside of the open second end 40 of the collar 22, is an inner surface 42 which can be contoured, for example include a series of alternating recesses 44 and ridges 46. One of ordinary skill in the art will appreciate that in certain embodiments, the contoured surface will be in a left-handed orientation and, in other embodiments, the countered surface will be in a right-handed configuration.

The collar 22 may also include slits 48 in the second end 40 that have a length less than the distance from the first end 38 to the second end 40. This results in the second end 40 having a plurality of splines 50. The splines 50 should have some degree of flexibility, which can be a function of both the material used to make the device 10 (or at least the collar 22) and the thickness and size of the splines 50.

The collar 22 may also include a threaded portion 52 on the outer surface 54. The member 24 has a complementary threaded portion 56 which engages the threaded portion 22 of the collar 22.

An embodiment of the device 10 will now be described in use. The face 30 of the shaft 20 is positioned to engage the substantially planar diametrically opposed upper head surface portions 16, and convex diametrically opposed upper head surface portions 18 of the head 14 of a one way fastener 12. If the one way fastener 12 is not countersunk, the collar 22 can be positioned around the head 14 of the one way fastener 12. If the inner surface 42 of the collar 22 is contoured (for example with recesses 44 and ridges 46) the inner surface 42 may engage the outer portion 28 of the head 14 of the one way fastener 12. If the collar 22 is correctly sized or configured, the setscrew 34 can be tightened, with an allen wrench for example, and then the device 10 rotated, removing the one way fastener 12.

If, however, the collar 22 does not fit around the head 14, because it is wrongly sized, or because of the imperfections discussed herein above, in an embodiment of the device 10, the member 24 can be rotated to move either towards the first end 38 of the collar 22 to allow for a larger head, or towards the second end 40 of the collar 22 to allow for a smaller head. This allows the device to have a first configuration for a first fastener and a second configuration for a second fastener.

As described above, as an alternative or in addition to the member 24, in another embodiment of a device 10 according to the present invention, the second end 40 has splines 50. If there is no member 24, and the collar 22 of the device 10 does not fit over the head 14 of the one way fastener 12, the splines 50 can be flexed to expand outwardly and allow the collar 22 to receive the head 14. The collar 22 can be hammered onto the head 14 or otherwise physically manipulated onto the head 14.

If the one way fastener 12 is counter sunk, the device 10 may be operated similarly to the above described method. However, the shaft 20 alone will be used to remove the one way fastener 12, at least until the head 14 of the one way fastener 12 is above the surface it was counter sunk into. At this point, the collar 22 can be positioned around the head 14, allowing the contoured surface (if present) to engage the outer portion of the head 14 of the one way fastener 12. Again, if the collar 22 does not fit around the head 14, the member 24 can be rotated, or the collar 22 can be hammered onto the head 14. Once the collar 22 is around the head 14, again, the setscrew 34 can be tightened and the device 10 rotated, resulting in the removal of the one way fastener 12.

In the embodiments of the invention described above, the device 10 allow for the device 10 to engage a plurality of differently sized one way fasteners.

The foregoing description is for purposes of illustration only and is not intended to limit the scope of protection accorded this invention. The scope of protection is to be measured by the following claims, which should be interpreted as broadly as the inventive contribution permits.

Without further elaboration, it is believed that one skilled in the art can use the preceding description to utilize the present disclosure to its fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles of the disclosure provided herein. In other words, various modifications and improvements of the embodiments specifically disclosed in the description above are within the scope of the appended claims. Note that elements recited in means-plus-function format are intended to be construed in accordance with 35 U.S.C. §112 ¶6. The scope of the invention is therefore defined by the following claims.

What is claimed is:

1. A device comprising:

a shaft having a face adapted to engage the recess of a one way fastener;

a collar having a first end, a second end, and an outer surface;

the first end having an aperture adapted to receive the shaft and wherein the aperture of the first end of the collar includes a threaded aperture and a setscrew;

the second end being an open end and having a diameter; and, the outer surface having a threaded portion, and, a member engaging the threaded portion such that rotation of the member provides the second end with a second diameter.

2. The device of claim 1, wherein the collar further comprises:

a plurality of slits having a length less than the distance from the first end to the second end.

3. The device of claim 2 wherein the collar further comprises:

the first end having a diameter being smaller than the diameter of the second end.

4. The device of claim 3 wherein the collar further comprises:

an inner surface having a plurality of recesses and a plurality of ridges.

5. The device of claim 1 wherein the face of the shaft comprises two lobed portions, each lobed portion including a flat end and a pointed end, the flat ends being adjacent to both pointed ends.

6. A device for removing a plurality of one-way fasteners, the device comprising:

a shaft having a face adapted to engage the recess of a one way fastener;

a collar having a first end with an aperture adapted to receive the shaft and a second end being an open end and having a first diameter corresponding to a head of a first one-way fastener from the plurality of one-way fasteners and a second diameter corresponding to a head of a second one-way fastener from the plurality of one-way fasteners;

the collar having a threaded portion on an outer surface and a member engaging the threaded portion;

a plurality of slits in the collar having a length less than the distance from the first end of the collar to the second end of the collar; and, the first end of the collar having a diameter being smaller than the first diameter of the second end of the collar.

7. The device of claim 6 further comprising:

an inner surface of the collar having a plurality of recesses and a plurality of ridges.

8. The device of claim 7 wherein the face of the shaft comprises two lobed portions, each lobed portion including a flat end and a pointed end, the flat ends being adjacent to both pointed ends.

9. A device for extracting a one way fastener, the device comprising:

a shaft having a face adapted to engage the recess of a one way fastener, wherein the face of the shaft comprises two lobed portions, each lobed portion including a flat end and a pointed end, the flat ends being adjacent to both pointed ends;

a collar having a first end and a second end;

the first end having an aperture adapted to receive the shaft;

the second end being an open end and having a diameter; and, a threaded aperture and a setscrew in the first end of the collar; and, a plurality of slits having a length less than the distance from the first end to the second end forming the second end into a plurality of flexible splines.

10. The device of claim 9, wherein the collar further comprises:

an outer surface having a threaded portion, and, a member engaging the threaded portion such that rotation of the member provides the second end with a second diameter.

11. The device of claim 10 wherein the collar further comprises:

the first end having a diameter being smaller than the diameter of the second end.

12. The device of claim 11 wherein the collar further comprises:

an inner surface having a plurality of recesses and a plurality of ridges.

* * * * *